US005623797A

United States Patent [19]

Gravier et al.

[11] Patent Number: 5,623,797

[45] Date of Patent: Apr. 29, 1997

[54] BLOCK STRUCTURE AND SYSTEM FOR ARRANGING ABOVE-GROUND FENCING, RAILING AND/OR SOUND BARRIERS

[75] Inventors: Robert A. Gravier, Bloomington; Tim A. Bott, Chanhassen, both of Minn.

[73] Assignee: Allan Block Corporation, Edina, Minn.

[21] Appl. No.: 504,700

[22] Filed: Jul. 20, 1995

[51] Int. Cl.[6] ..... E04B 1/04; E04B 2/46

[52] U.S. Cl. ..... 52/284; 52/270; 52/604; 52/606; 52/608; 256/19

[58] Field of Search ..... 52/603, 604, 605, 52/606, 608, 270, 284, 286; 256/19

[56] References Cited

U.S. PATENT DOCUMENTS

| | | | |
|---|---|---|---|
| 2,994,162 | 8/1961 | Frantz . | |
| 3,116,570 | 1/1964 | Torricelli | 52/603 X |
| 3,298,668 | 1/1967 | Schueren . | |
| 3,512,759 | 5/1970 | Resler . | |
| 3,534,518 | 10/1970 | Zagray . | |
| 3,905,170 | 9/1975 | Huettemann | 52/603 X |
| 3,962,842 | 6/1976 | Wilhelm . | |
| 4,124,961 | 11/1978 | Habegger | 52/603 X |
| 4,426,815 | 1/1984 | Brown . | |
| 4,524,551 | 6/1985 | Scheiwiller | 52/605 X |
| 4,726,567 | 2/1988 | Greenberg . | |
| 4,865,781 | 9/1989 | Jennings . | |
| 4,956,958 | 9/1990 | Caroti . | |
| 5,017,049 | 5/1991 | Sievert . | |
| 5,031,376 | 7/1991 | Bender et al. | 52/608 X |
| 5,365,714 | 11/1994 | Potvin | 52/605 X |

*Primary Examiner*—Carl D. Friedman
*Assistant Examiner*—Kevin D. Wilkens
*Attorney, Agent, or Firm*—Haugen and Nikolai PA

[57] ABSTRACT

Interlocking stackable block structures for use in erecting a shock-resistant wall array and including block structures in both fence block and post block configurations. The top surface of each of the blocks has a pair of parallelly disposed upwardly protruding laterally extending ridge projections which mate and interlock with projections formed on the bottom surface of the block. The block configuration is further provided with cores for drainage and load reduction purposes, but the upper and lower mating faces of the block have a load-bearing web which supports a superimposed stacked block thereon. The cores of the post block contain a reinforcing rod held in grout so as to provide strength and stability. Also, the post block structures are provided with recesses for lockingly receiving fence block therein, thereby providing an arrangement where the fence block array floats within the recesses and is thereby provided with a greater degree of stability.

3 Claims, 6 Drawing Sheets

20
29
36
32
43
30
26
24
42
35
25
21
40
37
27
38
23
22

49
55
45
50
47
46
52
54
53

45
49
55B
55A
50
46
53

60
61
62

90
91
91A
91B
92
94
95
96
97
98
99
100
101
102
104
105
106
107
108
109
W
X
Y
W/2
Y/2

BLOCK STRUCTURE AND SYSTEM FOR ARRANGING ABOVE-GROUND FENCING, RAILING AND/OR SOUND BARRIERS

BACKGROUND OF THE INVENTION

The present invention relates generally to a stackable block structure and system, and more specifically to an interlocking stackable block structure including both post block structures and fence block structures which, together, are arranged in a shock-resistant wall assembly. Each of the stackable blocks comprise a rectangular parallelepipedon with a pair of opposed major front and rear panels, each panel having a face surface, with the blocks further having a pair of opposed end wall surfaces and a top and a bottom surface. In order to prepare the shock-resistant wall assembly, the top surfaces of each of the post block structures and fence block structures have a pair of parallelly disposed upwardly protruding laterally extending ridge projections which mate with a bottom surface, and with the arrangement being such that a load bearing web between the front and rear panels provides full support for the stacked assembly. The arrangement further provides for inserting vertical reinforcing rods in the post block structures when arranged in a vertical column in order to complete a series of post block support structures for the overall assembly. The fence block structures are designed to receive horizontally disposed reinforcing rods in order to provide lateral stability for the completed fence panel assembly.

In the past, it has been common to utilize interlocking stackable block structures with the individual blocks comprising rectangular parallelepipedons. In addition, means have been provided for interlocking such block structures to erect wall assemblies and arrangements. Typically, however, these interlocked stackable wall structure arrangements lack shock resistance, and as such, are susceptible to damage and/or failure when exposed to impact and/or earthquake-type forces. The present arrangement provides an assembly of post block and fence block structures which together have been found to be resistant to certain forces, including those typically encountered in severe impact and/or earthquakes. The availability of a stackable block which provides a shock resistant structure is, of course, advantageous for a variety of reasons. The structures of the present invention, including both the post block and fence block structures are provided with internal cores in order to reduce the weight of the block, and also to provide a connection to the footing in the post block structures. The core in the fence block provides a means for receiving vertically spaced, horizontally disposed reinforcing rods in order to provide for improved lateral stability of the completed fence panel.

The arrangement of cores in the blocks of the present invention provide for improved drainage of water, a particularly important feature in areas where frequent freeze-thaw cycles occur. Also, the utilization of a core puller in the manufacturing process in combination with standard concrete block manufacturing equipment provides a substantial advantage when producing concrete blocks in quantity, and also when providing such blocks in simultaneous fashion to provide for textured and rock-like external surfaces.

The structure of the present invention further provides for stable half-block assemblies, an important feature in the mortarless structural assembly. The half-block structures provide for aesthetically pleasing and also laterally stable fence arrangements which, when assembled, are substantially free-floating in the zones between spaced-apart post block structures or columns.

In connection with the post block columns, these blocks are likewise provided with internal cores in order to integrate the columns with footings, and also providing a core for vertical reinforcement. The tie to the subterranean footings also accommodates a fill of grout. In connection with the fence block, these blocks are arranged to receive a horizontal tie or reinforcing rod which provides a stable overall assembly which floats between spaced-apart vertical post block columns. These interlocks further reduce and/or eliminate the need for footings along the fence portion, with the simplicity of the arrangement merely utilizing a suitably positioned leveling pad. The floating panel is accordingly interlocked and held in place by the spaced-apart vertical posts and/or columns.

As indicated above, the structure of the present invention is substantially free of mortar. In other stackable block structures of the prior art, arrangements are commonly made for providing mortar between layers and/or between individual blocks arranged in lines and/or rows.

The arrangement of the present invention provides an interlocking arrangement which is designed to be mortar-free, thereby providing a strong and durable structure for use as a privacy and/or fencing arrangement, and alternatively for a railing and/or sound barrier.

SUMMARY OF THE INVENTION

Briefly, in accordance with the present invention, interlocking stackable block structures for erecting a shock-resistant wall array or assembly is provided, with the blocks including both post block structures and fence block structures each having the typical rectangular parallelepipedon configuration. A pair of opposed major front and rear panels are also provided, each panel having face surfaces. These surfaces may be smooth, textured, or formed from a breaking of a double-block, thereby providing a desirable and aesthetically pleasing rock-like appearance or arrangement. Additionally, the block structure includes a pair of opposed end wall surfaces and a top and a bottom surface.

The top surface of the improved stackable post blocks and fence blocks have a pair of parallelly disposed upwardly protruding laterally extending ridge projections of truncated triangular cross-sectional configuration. These ridge projections are arranged to mate with a recess formed in the bottom surface of the wall structure, with the recesses forming a downwardly converging cross-sectional surface of inverted truncated triangular configuration. The web between the front and rear panels is designed to provide a load-bearing support for the stacked arrangement. The structure of the present invention further includes a post or pilaster block structure which is typically grout-filled to hold steel reinforcements. The array of fence blocks which extend between spaced-apart post block columns will typically include one or more fence beam block rows which are provided with horizontally disposed reinforcing rods to enhance lateral stability. In other words, certain spaced-apart and individual rows of fence block are arranged to receive steel reinforcing rods, and may typically be grout-filled during the stacking process.

In the arrangement of the present invention, the individual post blocks have a width which exceeds that of the fence block, and indeed includes a pair of abutting lateral extensions with a cavity or recess therebetween into which the fence block array is captured and held. In other words, the post block structure may have a 12-inch width with two 3-inch abutments at either end thereof forming a 6-inch fence block capturing recess therebetween.

Therefore, it is a primary object of the present invention to provide an improved interlocking stackable block structures for erecting a shock-resistant wall array or arrangement, where the individual block structures are provided with interlocking top and bottom surfaces which define intermediate webs for supporting the individual blocks in a vertically stacked arrangement.

It is yet a further object of the present invention to provide an interlocking stackable block structure for erecting a shock-resistant wall array or arrangement which comprises a stacked assembly of blocks of rectangular parallelepipedon structure, and including mating spaced-apart post block columns with rows of fence blocks interposed in captive arrangement therebetween.

Other and further objects of the present invention will become apparent to those skilled in the art upon a study of the following specification, appended claims, and accompanying drawings.

IN THE DRAWINGS

DESCRIPTION OF THE PREFERRED EMBODIMENT

Figure 1:
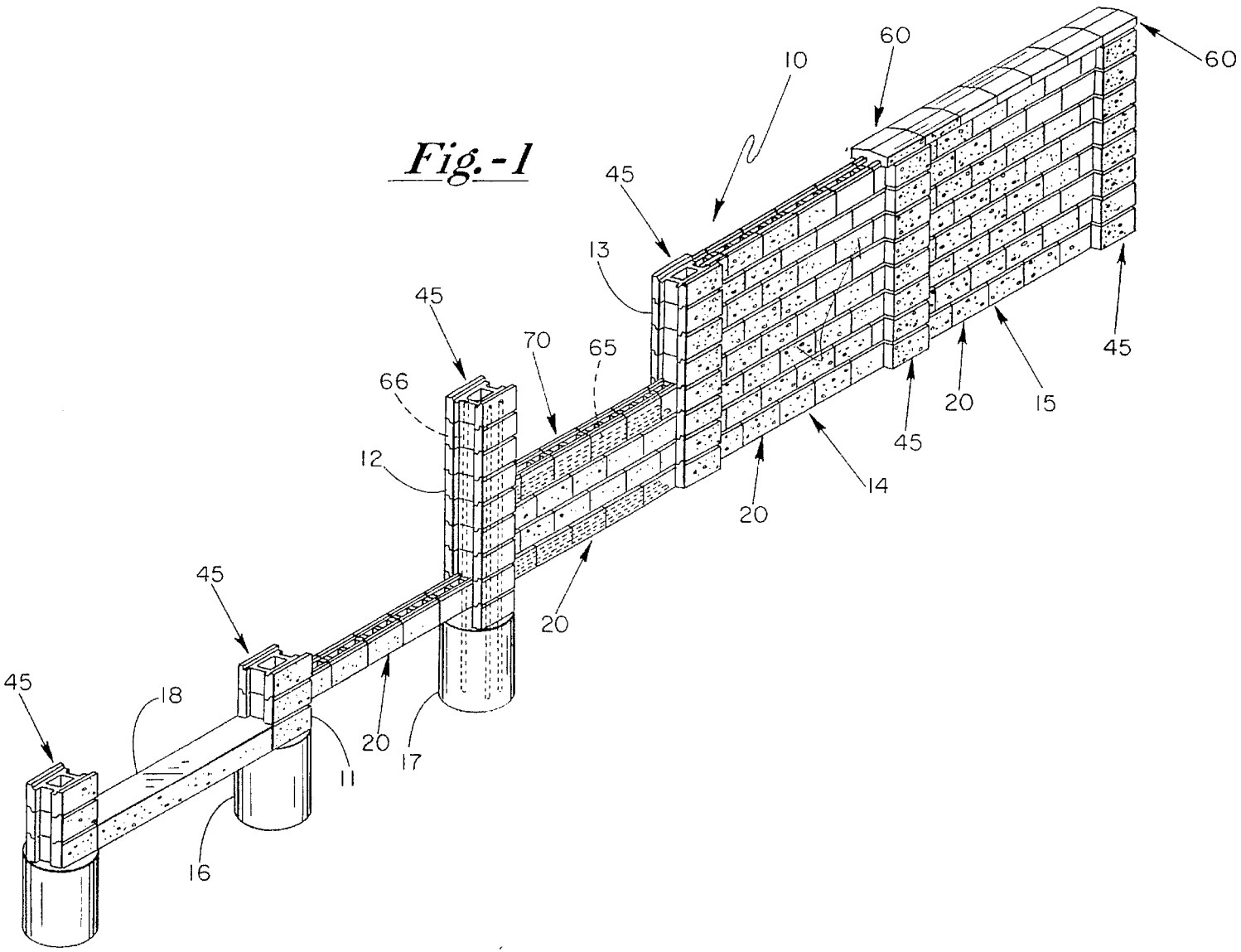
FIG. 1 is a perspective view of a series of partially completed block panels, with the arrays utilizing pilaster or post columns between adjacent panels, and with reinforcing rods being installed in one of the post block columns and being shown in phantom.

In accordance with the preferred embodiment of the present invention, and with particular attention being directed to FIG. 1 of the drawings, the above-ground fencing wall structure generally designated 10 includes a plurality of spaced-apart post columns 11, 12 and 13 shown in various degrees of completion, with fence block arrays being disposed therebetween as shown generally at 14 and 15. Where indicated, footings are provided as at 16 and 17, and with leveling pads for the individual fence block rows being utilized whenever required, and being illustrated at 18.

Figure 2:
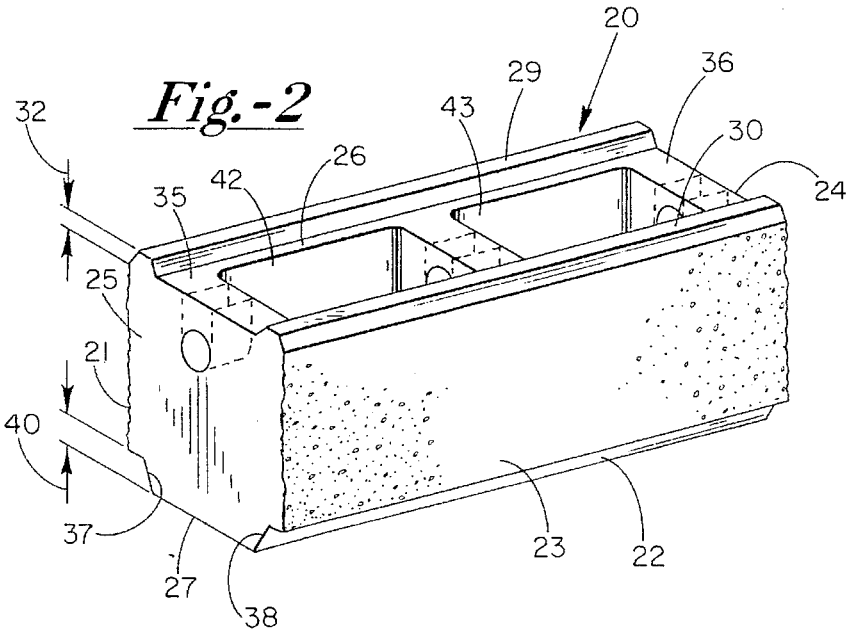
FIG. 2 is a perspective view of a fence block fabricated in accordance with the present invention.

Attention is now directed to FIG. 2 of the drawings wherein an individual fence block is shown. The block generally designated 20 is of rectangular parallelepipedon configuration with a pair of major opposed panels 21 and 22 being provided, with front and rear face surfaces as at, for example, 23. The rear panel 21 has a similar face surface, which is concealed in the view of FIG. 2. A pair of opposed end wall surfaces are also provided as at 24 and 25. A top surface is provided as at 26 along with a bottom surface as at 27. The top surface 26 has a pair of parallelly disposed upwardly protruding laterally extending ridge projections 29 and 30 of truncated triangular cross-sectional configuration. These upwardly protruding ridge projections have a first height dimension which is disposed in the zone 32 between the opposed arrows. These ridge projections are arranged for interlocking engagement with the bottom surface of a stacked block as indicated and described hereinbelow. The ridge projections 29 and 30 are integral with the major panels and have transverse planar load-bearing webs such as at 35 and 36. These webs have a first load-bearing surface along the upper edges. Bottom surface 27 has a pair of parallelly disposed front and rear recesses forming downwardly converging cross-sectional surfaces of inverted truncated configuration, such as at 37 and 38. Also, the height dimension of the inverted truncated triangle is illustrated at 40, with the dimension 40 being slightly greater than that of dimension 32. This arrangement provides for the web surfaces 35 and 36 to support the mating surface as at 27. Also shown in the fence block of FIG. 2 are hollow cores as at 42 and 43. Thus, at its upper end, the web provides a load-bearing surface which mates with the corresponding load-bearing surface of the block so as to arrange for a durable and solid superimposed stacked block array. The combination of the ridge projections and the load-bearing surface permit and indeed provide for mortar-free arrays. Furthermore, these features provide and enhance the stability of the assembly to be formed with one or more spaced-apart horizontally disposed fence-beam block rows carrying grout in the cores of the block and reinforcing rods horizontally therealong. This combination of features enhances the overall stability of the finished array.

Figure 3:
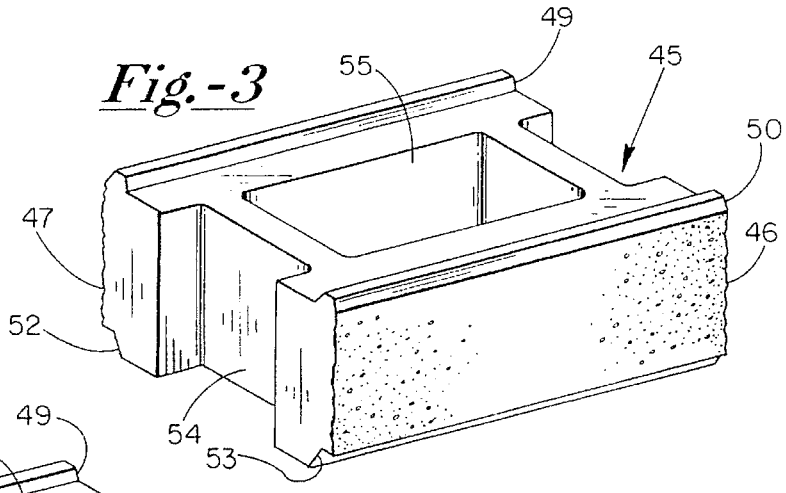
FIG. 3 is a view similar to FIG. 2 of a post block utilized to form a column.
Figure 4:
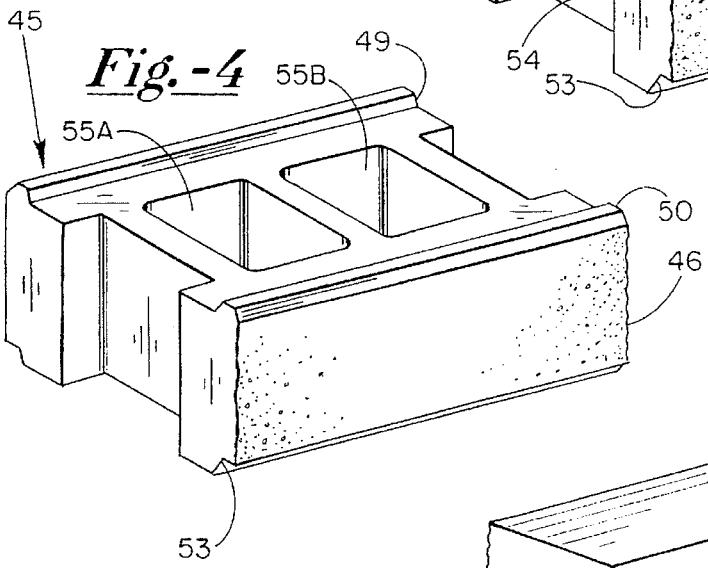
FIG. 4 is a view similar to FIG. 3 and illustrating a block with a pair of cores.

Attention is now directed to FIGS. 3 and 4 of the drawings wherein two alternative forms of a post block are illustrated. In FIG. 3, the block shown at 45 includes major front and rear panels as at 46 and 47, with these panels each having an exposed face surface. The face surface of panel 46 is shown as having a textured surface which results from a split-face fabrication, with the textured or split-face configuration providing a desirable and pleasing aesthetic appearance. The alternative embodiment in FIG. 4 is the same as shown in FIG. 3, excepting that the embodiment of FIG. 4 utilizes a pair of cores 55A and 55B, with the remaining features and description of the block being the same as illustrated and discussed in connection with FIG. 3 herein. The post blocks include parallelly disposed upwardly protruding laterally extending ridge projections as at 49 and 50, with these projections being otherwise similar to those described and discussed in connection with the fence block of FIG. 2. The bottom surface also has a pair of parallelly disposed front and rear recesses forming downwardly converging cross-sectional surfaces of inverted truncated triangular configuration in the same fashion as the fence block, with these recesses being shown as at 52 and 53. It will be noted that block 45 has a central recess formed therein between truncated areas 52 and 53, as at 54. This recess area as at 54 is spanned by the abutment surfaces that are indicated, with these abutment surfaces providing additional stabilization for the fence block mating therewith. The recess area 54 is designed to receive and capture the stacked fence block array therebetween. In this connection, the full width of the fence block is designed to fit within the recess 54, thereby adding stability and strength to the overall array. The height dimension arrangement as well as the web spanning the front and rear panels is designed in the same fashion as that of the fence block of FIG. 2. A hollow core arrangement is also illustrated as at 55, with the hollow core being designed to receive both grout and reinforcing rods.

As indicated in FIG. 1, post block column 12 shows, in phantom, vertically arranged reinforcing rod within the core of the block forming the column. These rods are typically placed within the footings as at 16 and 17 while the footings are being cast and are in raw or wet form. The rods are held vertically until the footing is set, at which time the post column is arranged thereover with the rods thereafter being cast within a column of wet concrete poured into the core of the column from the top thereof.

Figure 5:
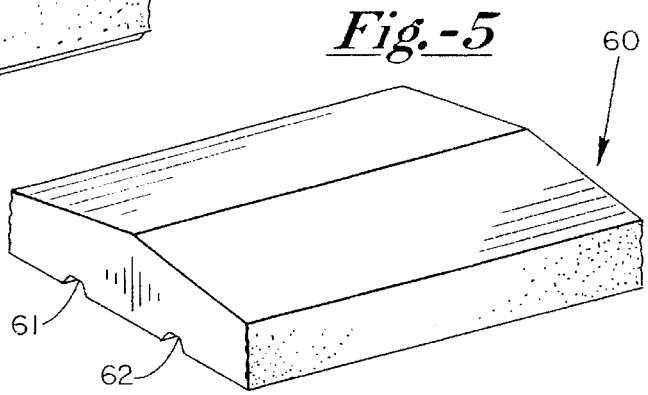
FIG. 5 is a perspective view of a cap block utilized in combination with the block of the present invention.

The cap block of FIG. 5 is shown generally at 60, with the block being provided with truncated triangular recesses as at 61 and 62 for receiving the ridge projections of mating post and fence block. The cap block is utilized to provide a finished appearance to the overall fence structure.

By way of example, for a fence block 6 inches wide, 18 inches long, and 8 inches in height, the height of truncated triangle shown at 32 is preferably one-half inch or 1.27 centimeters, while the actual height of the lower inverted truncated triangle shown at 40 is 0.625 inches or 1.58 centimeters. Utilizing these typical dimensions as applied to an 8-inch block, the blocks, when in an array, have both lateral and transverse stability achieved with a mortarless joint. The angular configuration for both truncated triangles is 26.5 degrees. It will be appreciated, of course, that other angular configurations may be utilized with angles of between about 25 degrees and 30 degrees being useful.

In order to erect a typical above-ground fence utilizing the block structures of the present invention, the fence location is initially staked out with a string line and proper post spacing is arranged. Thereafter, a shallow gravel or rock-filled trench, for example 10 inches wide and 6 inches deep, is provided around the entire fence line to form a leveling pad. A 12-inch diameter fence post hole is provided to a proper depth to form the footings for the post columns. Thereafter, starting at the lowest point in the fence line, each trench is leveled between the post holes, with steps being provided in 8-inch lifts (for an 8-inch block) as is typical in the art.

The base is formed starting at the lowest point of the fence line, where a post block column is centered over the post hole. The top of a post block is designed to be 2 inches below final grade, and leveled and back-filled to lock in place. Additional post blocks are arranged at the same elevation as the first post block, or otherwise in incremental lifts consistent with the height of the block being used. Thereafter, the tops of the blocks are leveled and back-filled. Using a string line and transit, a final check is arranged on alignment and elevation, whereupon a second course of post blocks is provided on each base. Crushed rock is installed in the trench to the top of the first post block, after which the fill is leveled and compacted.

In order to form the fence line base reinforcement, a base course of fence block is provided using spaced-apart fence beam block rows extending from post to post. As indicated, leveling pads may be employed for the fence rows, if desired. The webs of the individual blocks forming the fence block arrays are knocked out before setting to receive steel reinforcing rod as shown in phantom at 65, as indicated. Alternatively, a cutout may be provided in order to receive the reinforcing rod. Vertical steel reinforcing rod is provided in the post blocks, as indicated in phantom at 66, and concrete is poured in all fence beam block rows and finished to within about one-half inch of the top of the blocks. Such an arrangement is shown in the partially completed fence array disposed between post columns 12 and 13 in FIG. 1. In this unfinished array, the upper row is the one selected to receive the horizontally disposed steel reinforcing rod. Concrete is poured into all post blocks to fill holes at least up to the level of the first course of block. The entire base row is checked for straightness, level and alignment. Thereafter, the arrangement is permitted to cure overnight.

To complete the fencing, the remaining post blocks are stacked to a level equal to the top of the fence. Construction adhesive may be employed between courses, it being noted, of course, that mortar is not required. After checking for level or alignment, additional rows of fence block are formed to the height of the next fence beam block, with the fence beam block being illustrated in FIG. 1 as shown generally at 70. A row of fence beam block is then set in place and steel reinforcing rod 65 is provided as indicated. Vertical steel is then installed in the core of the post column and concrete is poured to the level of the top of the post. Concrete is then poured into the fence beam block cores as required (after blocking the cores to provide concrete only along the fence beam block), with the concrete being finished to a level of about one-half inch below the top of the individual fence beam block row. After checking for level and straightness, the arrangement is adjusted as required.

For completion, the remaining fence blocks forming the array are stacked to the top of the fence, cap blocks as shown in FIG. 5 are installed, and the structure is complete. A completed fence block array is shown completed as the fence block array 15 in FIG. 1.

Figure 6:
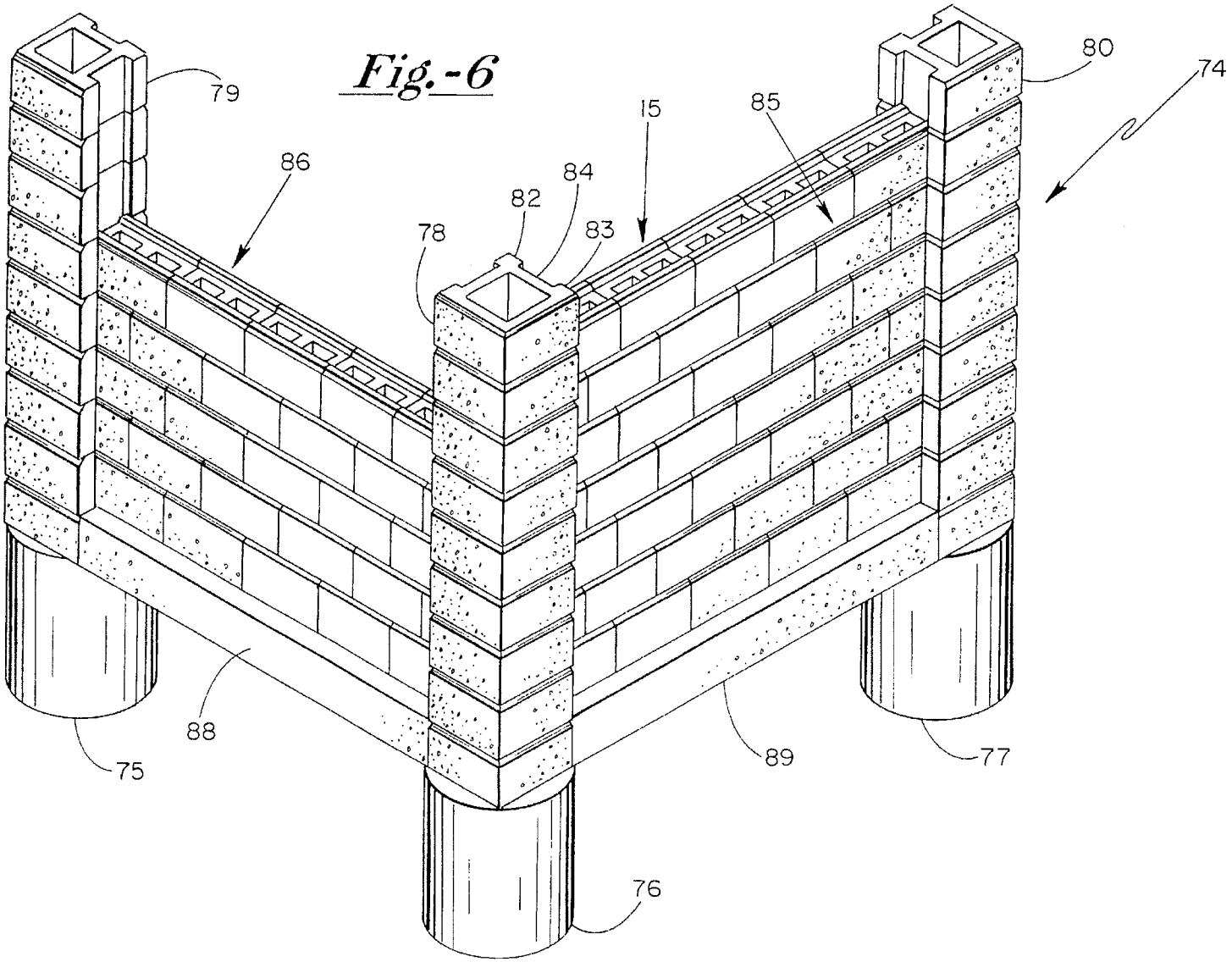
FIG. 6 is a perspective view of a partially completed block wall array shown in various stages of completion, with the wall panels being fabricated from the interlocking block arrangements of the present invention, and illustrating spaced-apart columns of post block columns in a corner configuration.

With attention being directed to FIG. 6, it will be observed that the partially finished corner array generally designated 74 includes post column footings 75, 76 and 77. The fence block arranged therebetween is the same as the fence block shown in FIG. 1. In connection with the structure of FIG. 6, however, a corner post block arrangement is provided at 78, with the post block arrangement being provided in a manner similar to that of the block forming columns 79 and 80. The corner block column is designed as a block with a larger cross-section, and having the abutment members 82 and 83 and the recess 84 disposed at right angles, one to the other. Those skilled in the art will, of course, be able to fabricate such corner blocks substantially based upon the configuration of the linear post blocks 45.

With continued attention being directed to FIG. 6, the individual panels generally designated 85 and 86 are disposed between spaced apart post columns 78, 79 and 80, as indicated, with the individual panels resting upon and being supported by footings 88 and 89. In completing the arrangement, the columns 78, 79 and 80 will, of course, be filled with grout and reinforced with a conventional reinforcing rod.

Figures 7, 8:
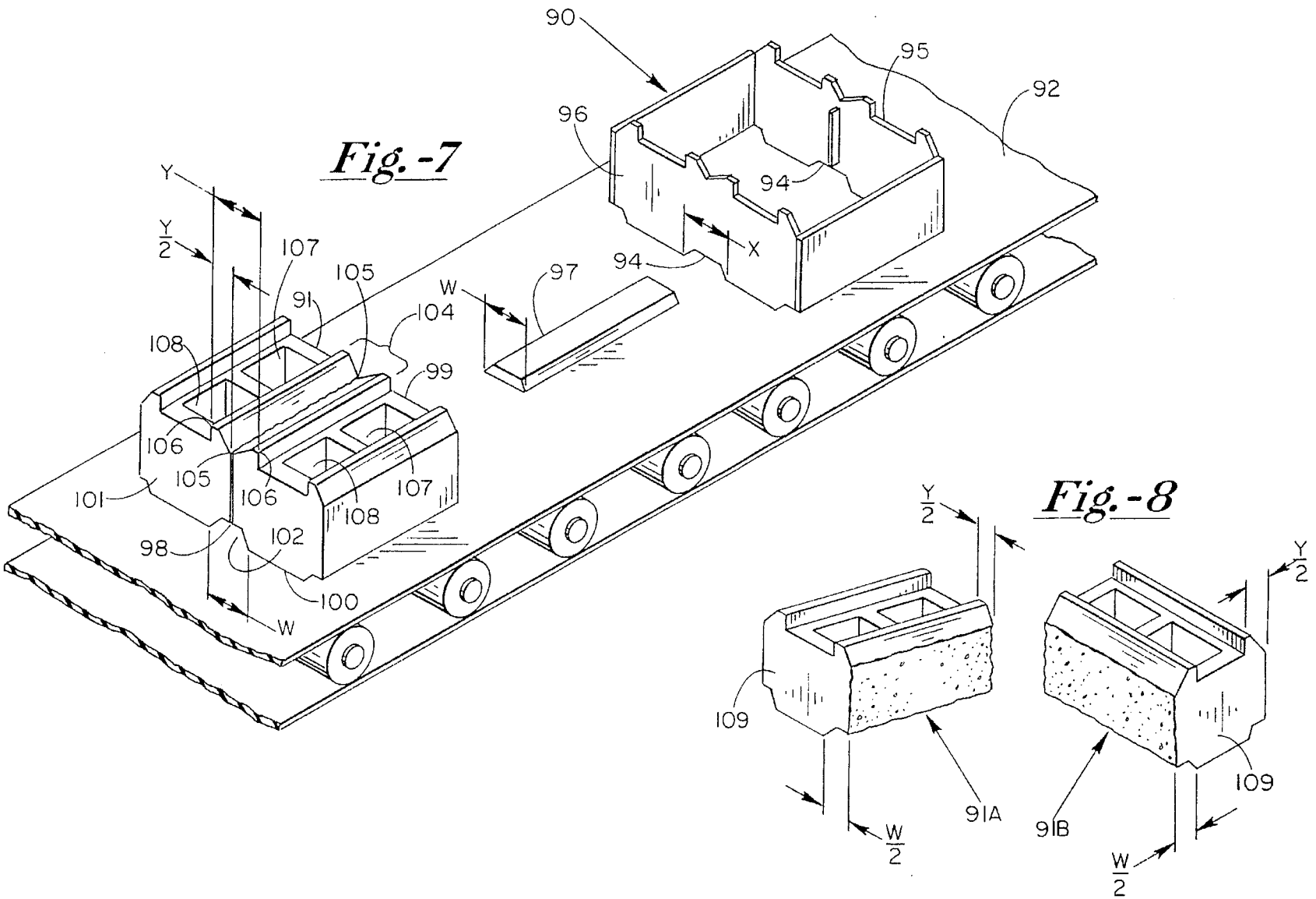
FIG. 7 is a perspective view showing the open end portion of a double-block mold box for fabricating blocks in accordance with the present invention and a double block from the mold box, and further illustrating the removed core utilized to create certain features of the configuration.
FIG. 8 is a perspective view of a pair of blocks created from the double block of FIG. 7, subsequent to splitting.

Attention is now directed to FIGS. 7 and 8 of the drawings wherein a mold box generally designated 90 is illustrated. The arrangement illustrated in FIG. 7 is disclosed in detail in copending application Ser. No. 08/142,715, filed Oct. 25, 1993 of Robert A. Gravier, and entitled "Method of Forming Concrete Retaining Wall Block", and assigned to the same assignee as the present invention. This process includes block molding the rectangular composite masonry block 91 by filling rectangular mold box 90 with mix and casting the block by compressing the mix and the mold through the application of pressure to the exposed mix at the open upper end of the block mold. Additional discussion of the general features of the method are provided in U.S. Pat. No. 5,017,049 to D. J. Sievert, the content of which is incorporated herein by reference. Mold box 90 is placed on a standard conveyor belt 92. Specifically, mold box 90 is comprised of a rectangular structure having an open top and bottom and with a trapezoidal opening 94 defined in each of opposing sides 95 and 96 of mold 90. Each trapezoidal opening 94 is defined at a center lower portion of each respective side wall 95 and 96. Each opening 94 has a predetermined width dimension "X", as shown. An accessory to mold 90 is implemented in combination therewith shown as core bar 97. Core bar 97 is comprised of a longitudinally extending rectangular member having a width dimension "W", as shown. However, core bar 97 could have a trapezoidal shape as well. Prior to the molding process, core bar 97 is disposed longitudinally such that it extends through both openings 94 and is centered therein. A plurality of core bars 97 are available to be implemented with mold 90, each having a different width "W". However, the width dimension "W" of core bar 97 is less than or equal to the width dimension "X" of each opening 94. Core bar 97 defines a laterally extending notch 98 extending across the major surface of block 91 including the entire width thereof.

With continuing reference to FIGS. 7 and 8, composite block 91 formed from mold 90 is a rectangular block with an upper major surface 99 and an opposing lower major surface 100. Block 91 has a pair of opposing major sides 101—101 wherein a laterally extending notch 102 extends therebetween along the center of block 91. Notch 102 is formed by the selected core bar 97 disposed through openings 94—94 of mold 90 during the molding process. Subsequently, when core bar 97 and mold 90 are removed from the block, notch 102 is defined. Accordingly, the width "W" of notch 102 is identical to the width "W" of the associated core block 97 used during the molding process. The width of notch 102 can be selectively determined by choosing the appropriate core bar 97 with a selected width "W". The width "W" of notch 102 directly corresponds to a setback dimension which is established when the blocks formed are stacked and assembled into a retaining wall.

Block 91 can also be seen to include a laterally extending ridge 104 extending between the opposing major walls 101—101 along the center thereof to bisect block 91, with ridge 104 being parallel to and vertically defined above laterally extending notch 102. Ridge 104 is further defined as having a V-shaped notch or groove 105 extending along the length thereof and bisecting ridge 104 into a pair of lips 106. To reduce the weight of block 91 and the pair of blocks resulting or defined therefrom, a pair of vertically extending core openings or hollows as at 107–108 are provided on each side of ridge 104, each opening 107–108 extending from upper major surface 99 to lower major surface 100. A solid reinforcing web may be defined perpendicularly between each pair of openings 107–108 as shown.

Ridge 104 is particularly characterized as having a predetermined width dimension "Y", wherein the width of each lip 106 has a dimension "Y/2". Therefore, elongated V-shaped notch 105 bisects or forms a pair of identically elongated and configured lips 106. The dimension "Y" remains fixed as the dimension "W" may be selectively defined.

Block 91 provides a means for creating two individual blocks, such as blocks 91A and 91B. The blocks are configured with appropriate abutments or channels, and are provided, of course, with solid end surfaces as at 109. The blocks illustrated in FIG. 8 are typically used as free-standing retaining wall blocks, with the illustration here being made for illustrative purposes, and as the arrangement relates to the mold box configuration illustrated in FIG. 9. As set forth hereinafter, the mold box is provided with an arrangement of parts, components, and features to produce fence wall panel-forming members such as illustrated at 132 and 133 of FIG. 11.

Figure 9:
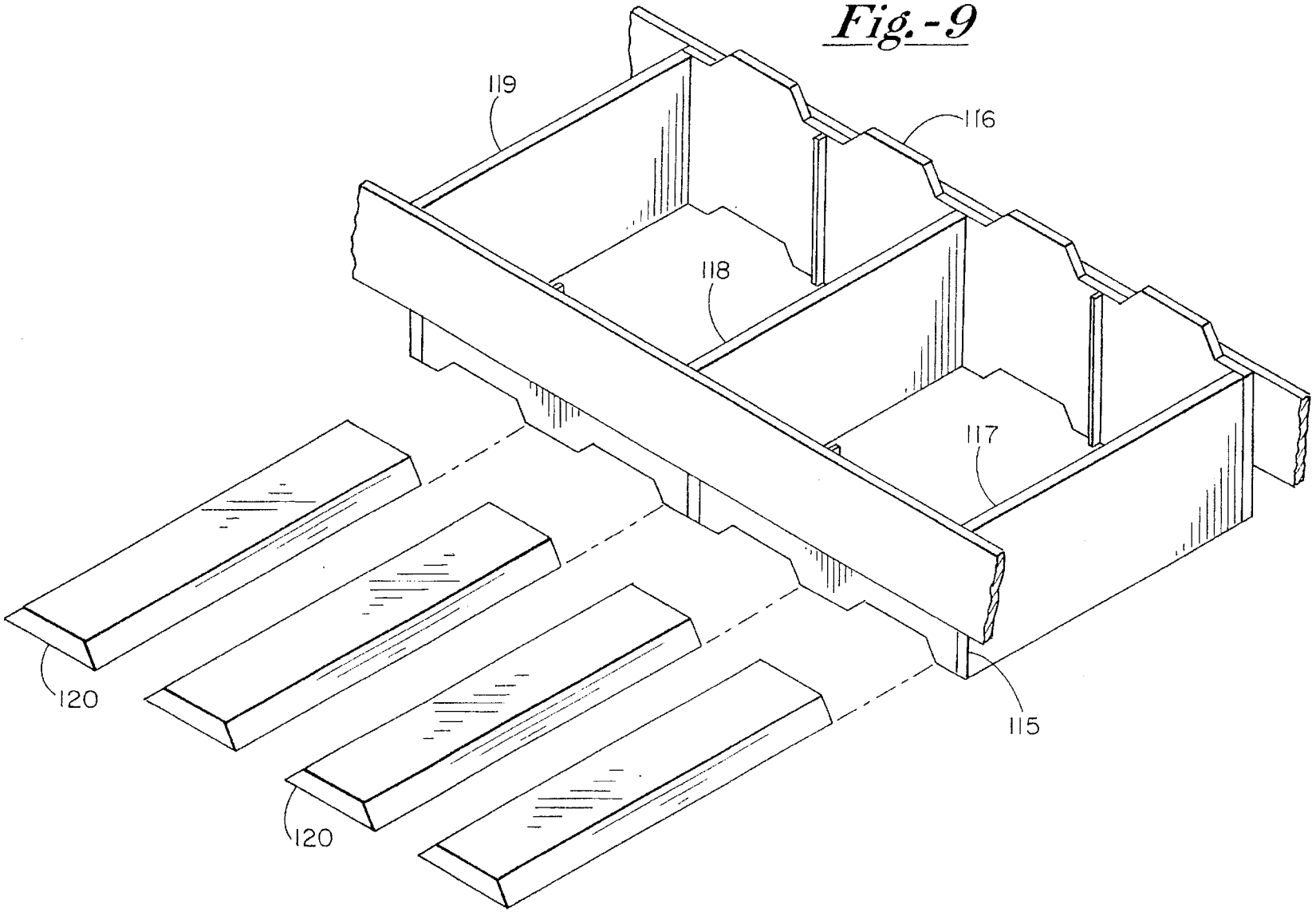
FIG. 9 is an exploded view illustrating a mold box with portions removed, and illustrating the puller bars for the bottom notch in exploded or extended disposition.

With attention now being directed to FIG. 9 of the drawings, a fence block mold box is illustrated for simultaneously producing four blocks. The box includes end walls or end panels as at 115 and 116 together with side panels 117, 118 and 119. Puller bars are provided and shown at 120—120, as indicated. Puller bars 120—120 form the bottom notch of the block of the configuration shown in FIG. 2. The web surfaces such as shown in FIG. 2 at 35 and 36 are formed by the introduction of core-forming sleeves moving along an axis transverse to the axis of motion of the puller bars 120—120.

Figure 10:
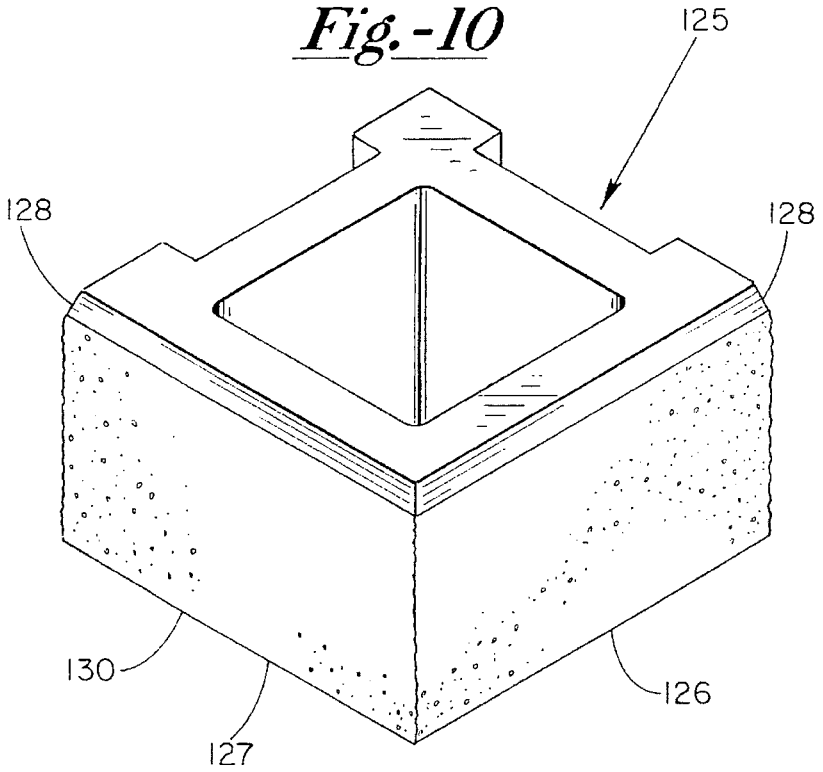
FIG. 10 is a perspective view of a corner post block useful in connection with fabricating structures with blocks prepared in accordance with the present invention.

With attention now being directed to FIG. 10 of the drawings, a corner post block is illustrated, with the block being shown generally at 125. Block 125 includes face members 126 and 127 arranged at right angles, one to another, along with a top beveled zone as at 128. The beveled zone 128 is utilized to permit the blocks to be bonded together and to form a gasket for the grouting operation. A mating downwardly extending bevel may be provided on the undersurface of the block 125, such as at an adjacent edge surface 130.

Figure 11:
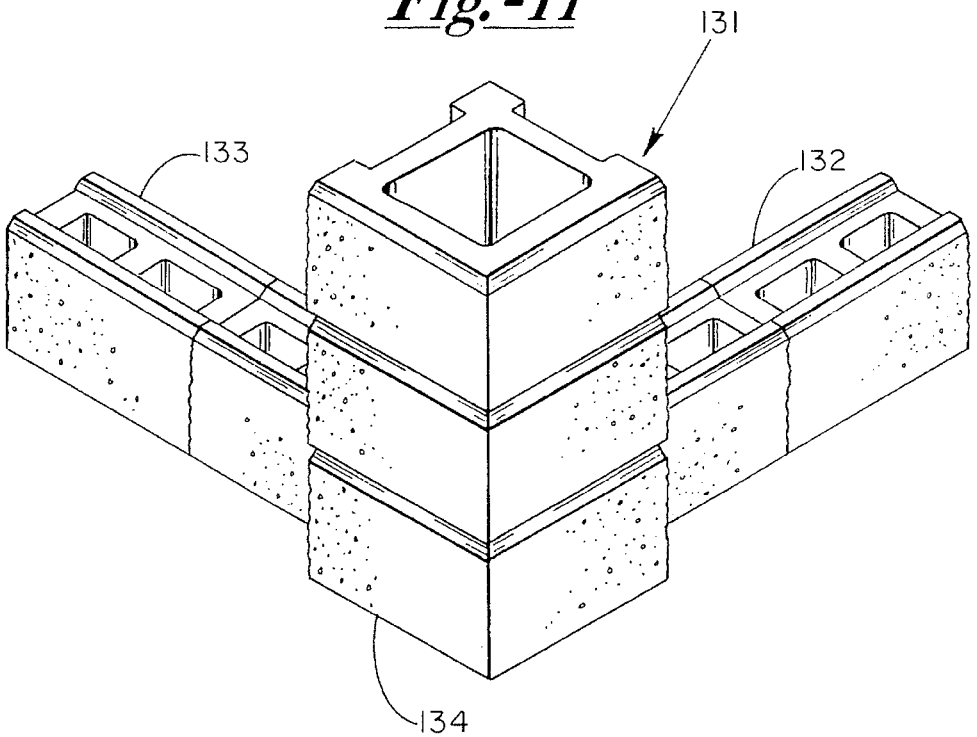
FIG. 11 is a perspective view of a corner post block and wall block configuration, partially assembled.

With attention now being directed to FIG. 11 of the drawings, a detailed view of a corner arrangement is illustrated, with the corner post generally designated 131 supporting and guiding individual wall segments as at 132 and 133. These individual segments 132 and 133 are permitted to float independently of the corner post 134.

As has been indicated herein, the block structure and system for arranging above-ground fencing is durable, and is capable of resisting reasonable shock loading. Such an arrangement is, of course, valuable in areas where ground tremors may occur, with the fencing being able to provide secure, durable, long-lasting arrays and panels, which are resistant to damage and/or destruction when subjected to shock loading and/or earth tremor forces.

The arrangements illustrated herein are provided for illustration only and are not to be construed as a limitation upon the scope of the present invention.

What is claimed is:

1. In an interlocking stackable block structure for erecting a shock-resistant wall arrays, and comprising a plurality of rectangular parallelepipedons with a pair of opposed major front and rear panels each having a face surface, a pair of opposed end wall surfaces and a top and a bottom surface; the improvement comprising:

(a) said top surface having a pair of parallelly disposed upwardly protruding laterally extending ridge projections of truncated triangular cross-sectional configuration and having a first height dimension for interlocking engagement with the bottom surface of a block in an adjacent stacked row, said ridge projections being integral with said major panels and with said blocks having a hollow core formed therein extending through said block between said top and bottom surfaces, and with a transverse planar load bearing web having a top surface disposed normal to the plane of said front and rear panels and extending between said panels laterally of said hollow core and with said web having a first load bearing surface and defining the upward extension thereof;

(b) said bottom surface having a pair of parallelly disposed front and rear recesses forming downwardly converging cross-sectional surfaces of inverted truncated triangular configuration having a second height dimension greater than said first height dimension for receiving and engaging said laterally extending ridge projections and providing load support of a superimposed stacked block on said planar load bearing web; and (c) said front and rear recesses defining a lower web with a load bearing surface therein so that the surface of said lower web provides a second load bearing surface mating with the first load bearing surface of a superimposed stacked block.

2. The wall structure as described in claim 1 being particularly characterized in that said interlocking stackable block structures further include post blocks stacked in interlocking stacked relationship with said fence blocks.

3. The wall structure as defined in claim 2 being particularly characterized in that said post blocks are provided with laterally extending abutments forming fence block retaining recesses therebetween.

* * * * *